United States Patent [19]

Beese et al.

[11] 4,152,236

[45] May 1, 1979

[54] APPARATUS FOR CONTROLLED POTENTIAL PITTING CORROSION PROTECTION OF LONG, NARROW STAINLESS STEEL TUBES

[75] Inventors: Ronald E. Beese, Barrington; Niranjan M. Parikh, Winnetka, both of Ill.

[73] Assignee: American Can Company, Greenwich, Conn.

[21] Appl. No.: 822,349

[22] Filed: Aug. 5, 1977

[51] Int. Cl.[2] ..... C23F 13/00

[52] U.S. Cl. ..... 204/197

[58] Field of Search ..... 204/196, 197

[56] References Cited

U.S. PATENT DOCUMENTS

| | | | |
|---|---|---|---|
| 1,804,078 | 5/1931 | Badan | 204/197 |
| 2,513,124 | 6/1950 | Weiks | 204/197 |
| 2,784,156 | 3/1957 | Maurin | 204/197 |
| 3,182,007 | 5/1965 | Hutchison et al. | 204/147 |
| 3,477,930 | 11/1969 | Crites | 204/197 |

*Primary Examiner*—Howard S. Williams

*Attorney, Agent, or Firm*—Robert P. Auber; George P. Ziehmer; Harry W. Hargis, III

[57] ABSTRACT

Zinc or iron sacrificial anodes, or the cathodic current from a DC current source applied through a platinum electrode, provide stainless steel protection from pitting corrosion particularly in the interior of long narrow stainless steel tubes exposed to hot concentrated chloride brine. The invention is characterized by the placing of an anode in a brine solution near one end and electrically connected to a stainless steel tube, thereby protecting the interior of the stainless steel tube along its entire length from pitting corrosion by the brine.

9 Claims, 2 Drawing Figures

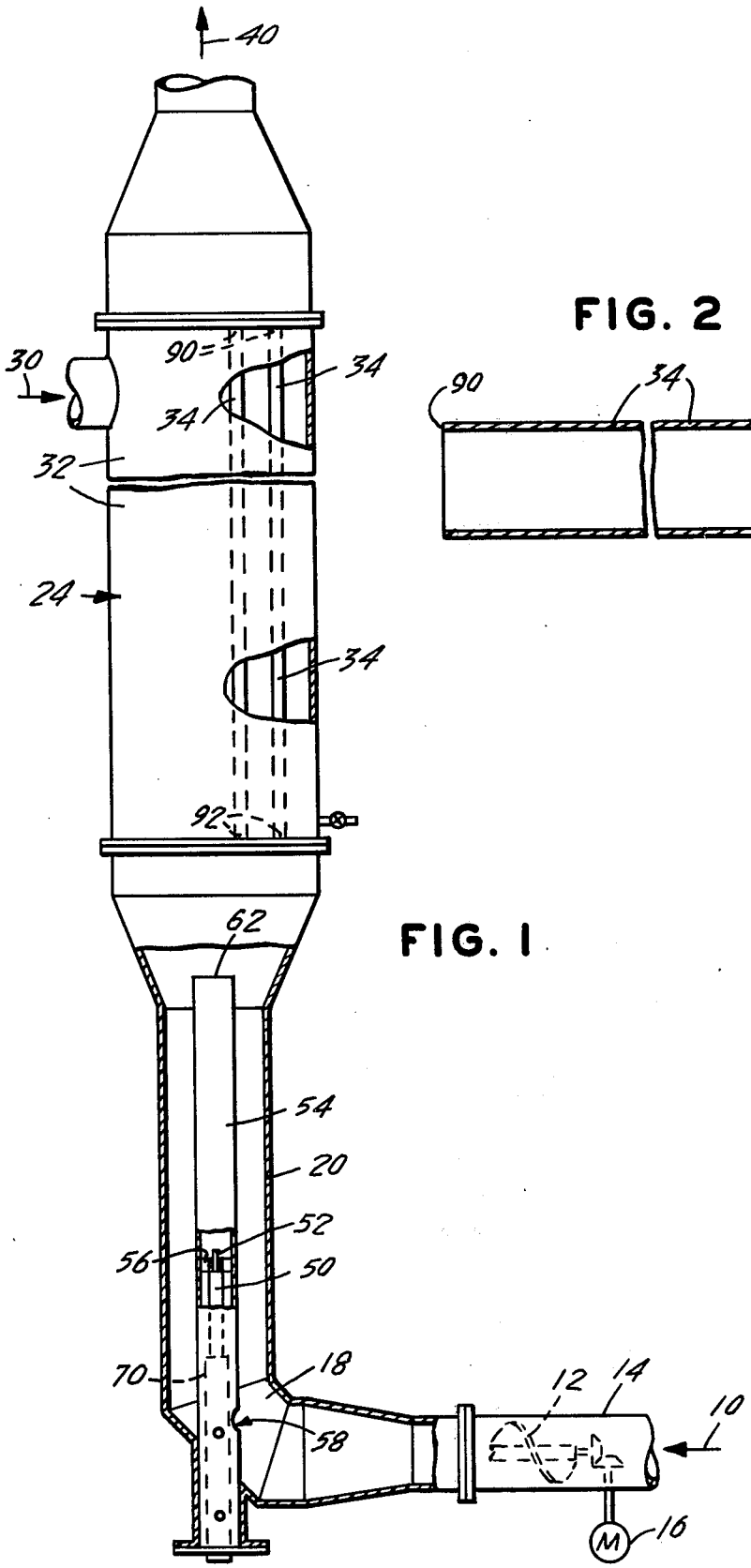
FIG. 1
FIG. 2
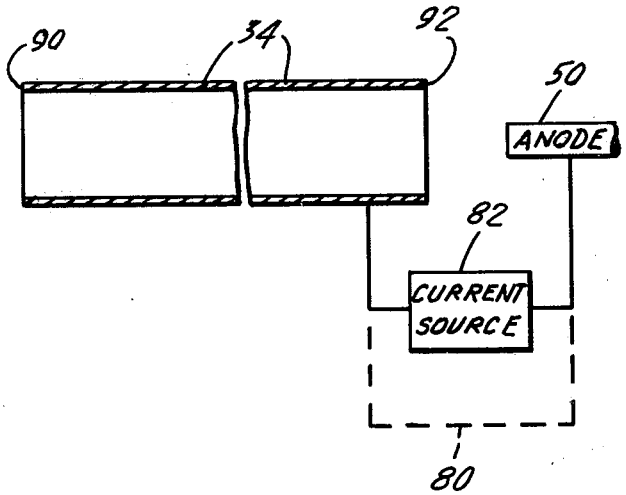

APPARATUS FOR CONTROLLED POTENTIAL PITTING CORROSION PROTECTION OF LONG, NARROW STAINLESS STEEL TUBES

BACKGROUND OF THE INVENTION

R. Baboian and G. S. Haynes have written a paper entitled "Galvanic Corrosion of Ferritic Stainless Steels in Sea Water" which is published in "Corrosion in Natural Environments", ASTM STP 558, American Society for Testing and Materials, 1974, pages 171 through 184. The paper describes the corrosion of stainless steels in sea water solutions, and particularly notes in FIG. 3, page 175 that when the potential on the stainless steel is more active than a critical potential, designated $E_p$, no pitting corrosion of the stainless steel occurs.

A similar figure is in an article by J. F. Bates entitled "Cathodic Protection to Prevent Crevice Corrosion of Stainless Steels in Halide Media" which appears in "Corrosion", Volume 29, pages 28 through 32, January, 1973.

When describing the invention, ASTM Standard G3-74, "Standard Recommended Practice for Conventions Applicable to Electro-Chemical Measurements in Corrosion Testing" will be followed.

Protection of stainless steel in the presence of chloride ions from pitting corrosion comprises the steps of inducing cathodic currents in the stainless steel in conjunction with active voltages. The active voltages are everywhere on the stainless steel greater than a predetermined minimum voltage which preferably is at least −500 millivolts with respect to a silver-silver chloride reference electrode. Causing the induced active voltages to exceed −700 millivolts unnecessarily substantially increases the current requirements and the energy used in the protection. Further, when the current flow is caused by a sacrificial anode, the anode is unnecessarily rapidly used.

Prior to this invention, protection of the interior of stainless steel tubes from pitting corrosion was believed impossible by the use of an exterior anode beyond about three to five diameters into the tube.

BRIEF DESCRIPTION OF THE INVENTION

In the embodiments of this invention, an anode is placed in a highly concentrated chloride ion brine solution exterior to a tube of stainless steel containing the same solution and adjacent to one end thereof.

In one embodiment of the invention, a platinum anode is used with an external current source connected to the inert platinum electrode and to the stainless steel tubing causing cathodic current to flow to the interior surface of the stainless steel tubing.

In a second embodiment of the invention, an iron anode is used, and in a third embodiment of the invention a zinc anode is used. The iron or zinc anodes electrolytically produce a cathodic current flow from the anode, through the brine, to the interior surface of a stainless steel tube thence by an external circuit back to the anode. The current flow also destroys the anode. The dissolution of the iron or zinc anode produces the driving electromotive force for the cathodic current. In each of these embodiments, the corrosion potential of the interior of the stainless steel tubing is induced to be from −500 millivolts active voltage with respect to a silver-silver chloride reference electrode at the far end of the tube to −700 millivolt active voltage at the end of the stainless steel tube adjacent to the anode. Measurements inside the tube indicate that the corrosion potential distribution along the tube is between the −500 millivolt and the −700 millivolt potentials.

Ordinarily to protect the interior of the stainless steel tube one would expect that the anode would need to be located in the interior of the tube and extend substantially the full length of the tube. The inventors of this invention have found however that the current flow actually extends through the concentrated chloride brine in the tube to the distal end of the tube. For example, in a 1⅜ inch diameter tube the protection extends to the distal end of a tube which may be 20 or more feet away.

One explanation of the extent of the protection along the interior of the stainless steel tube is that an electrically resistive coating forms on the interior surface of the stainless steel tube which prevents all of the current flow from occurring at the end of the stainless steel tube adjacent the anode.

It is therefore an object of this invention to cathodically protect the interior of a long cylindrical stainless steel tube in the presence of concentrated chloride ion brine solutions. It is another object of this invention to protect the interior of a stainless steel tube in excess of a length five times the diameter of the tube in the presence of a brine within the interior of the tube from pitting corrosion.

It is still a more particular object of this invention to induce active corrosion potentials along a stainless steel tube in the presence of brine, said potentials varying from −500 millivolts with respect to a silver-silver chloride reference electrode at the far end of said stainless steel tube to −700 millivolts at the other end adjacent a protective anode.

BRIEF DESCRIPTION OF THE DRAWINGS

Other objects will become apparent from the following description, taken in conjunction with the accompanying drawings, in which:

FIG. 1 is a structural drawing, with a portion broken away, of a plurality of stainless steel tubes carrying hot concentrated salt water in a heat exchanger in a salt recovery plant; and FIG. 2 is a schematic diagram showing rudimentary circuits used with an anode adjacent a stainless steel tube to be protected.

DETAILED DESCRIPTION OF THE INVENTION

In a salt recovery plant it is necessary to heat concentrated salt brine solution. Stainless steel tubes or pipes may be used in a heat exchanger to heat the salt brine. Typically 1⅜ inch inside diameter stainless steel tubes carry salt brine, and the tubes are surrounded by steam in a steam jacket to deliver heat from the steam to the salt brine. It is in this environment that the concepts of this invention were conceived. Without the protection of this invention, the stainless steel tubes corroded through in a matter of days of operation.

Referring to FIG. 1, concentrated salt solution is pumped in as shown by the arrow 10 by a pump 12 in the salt brine delivery pipe 14. The pump 12 is typically driven by an external motor 16. The salt brine is delivered through elbow 18 to an upstanding pipe 20. It is understood that the pipe 20 may have a diameter, for example, on the order of two feet.

The salt brine is delivered to a heat exchanger section 24 which may, for example, have on the order of 340 pipes of stainless steel, each 1⅜ inch internal diameter and having a length of twenty feet. Steam is delivered, as shown by arrow 30, into the steam jacket 32 and surrounding the outside of the stainless steel pipes, two of which are shown at 34. The heated salt brine then is delivered from the heat exchanger 24 as shown by the arrow 40.

To protect the interior of the stainless steel tubes 34, as well as any other stainless steel which may be in contact with the salt brine, a zinc electrode 50 extends into the salt brine solution, and it is supported by an iron mandrel 52. The iron mandrel 52 is in turn supported within the plastic tube 54 by a spider 56. The tube 54 has a hole therein at 58 to allow brine to flow into the hole, upward through tube 54 and out of its upper end 62. Plastic tube 54 limits the amount of current that flows from the zinc electrode 50 to the adjacent pipe side walls. The lower plastic collar 70 is an electrical insulator surrounding the zinc electrode 50. The anode 50, as shown by the dashed line 80 in FIG. 2, is electrically connected externally to the proximal end 92 of the stainless steel tube 34. As current flows due to the voltage generated by the anode 50, the anode 50 is slowly dissolved in the brine.

Instead of a zinc anode 50, an iron anode could be used. As long as the zinc is present, it will protect the adjacent iron mandrel 52.

A platinum anode may be used in place of the zinc, but with a platinum anode external current source 82 needs also to be used because a platinum anode does not react with the chloride brine to generate the correct voltage. Accordingly, a current source 82 is connected between the platinum anode 50 and the stainless steel tubes 34 to deliver a current source in the proper direction and proper polarity to eliminate pitting corrosion of the stainless steel.

With the current flow such that the end 90 of the stainless steel tubes 34 distal from the anode 50 has an active −500 millivolt potential, measurements made along the interior of a stainless steel tube indicates an increase of voltage as one measures closer to the proximal end 92 of the stainless steel tubes 34 adjacent the anode 50. For example, with a twenty foot section of 1⅜ inner diameter stainless steel tube the interior of the tube varied along the tube from an active −500 millivolt potential at the distal end 90 to an active −700 millivolt potential at the end 92 proximal to the anode 50.

In practice, the plastic tube 54 may have a diameter on the order of 8 inches, the electrode 50 may have a length on the order of 6 feet, and the plastic tube 70 may be on the order of 4 inches in diameter.

Flow of cathodic current in the stainless steel tubes 34 protects the stainless steel. The anode 50 must be near enough to the stainless steel tube that the interior of the tube to be protected in contact with the concentrated hot brine is everywhere within the active potential range of −500 to −700 millivolts relative to a silver-silver chloride reference electrode in the brine, preferably adjacent the distal end 90 of the tubes 34.

Although the reference electrode could be left in place, it is not necessary once the apparatus is properly adjusted. Accordingly the reference terminal is not shown.

Although the invention has been described in detail above, it is not intended that the invention should be limited by that description but only in accordance with that description taken together with the accompanying claims.

We claim:

1. Means for protecting the interior of a long stainless steel tube, having a length in excess of five of its diameters, from pitting corrosion in the presence of chloride brine comprising:

a sacrificial anode in said chloride brine disposed exteriorly of and adjacent one end of said tube, said anode having electro-chemical characteristics in said brine to induce an active voltage of at least −500 millivolts, measured relative to a silver-silver chloride reference electrode in said brine, at every point on the interior of said tube; and means defining an electrical current return path between said anode and said one end of said tube, externally of said brine, in accommodation of current flow from said anode, through said brine, to the interior surface of said tube.

2. Means as recited in claim 1 in which said reference electrode is in said brine at the end of said tube opposite said one end.

3. Means as recited in claim 1 in which said anode is zinc.

4. Means as recited in claim 3 and further comprising insulative material immersed in said brine and disposed around a portion of said anode to limit current flow through said brine to adjacent structures, said material being shaped and disposed to direct brine flow over said anode and toward said one end of said tube.

5. Means as recited in claim 1 in which said anode is iron.

6. Means as recited in claim 1 in which the interior of said tube is at an active voltage range between −500 millivolts and −700 millivolts relative to said reference electrode.

7. Means for protecting the interior of a long stainless steel tube, having a length in excess of five of its diameters, from pitting corrosion in the presence of chloride brine comprising:

an anode in said chloride brine disposed exteriorly of and adjacent one end of said tube; and a current source connected externally of said brine between said anode and said one end of said tube, and operative to deliver cathodic current to the interior surface of said tube to induce an active voltage of at least −500 millivolts, measured relative to a silver-silver chloride reference electrode in said brine, at every point on the interior of said tube.

8. Means as recited in claim 7 in which said anode is platinum.

9. Means as recited in claim 7 in which the interior of said tube is at an active voltage range between −500 millivolts and −700 millivolts relative to said reference electrode.

* * * * *